US006434957B1

(12) United States Patent
Nishizuka et al.

(10) Patent No.: US 6,434,957 B1
(45) Date of Patent: Aug. 20, 2002

(54) OPERATION CONTROL METHOD FOR AIR CONDITIONING SYSTEM AND AIR CONDITIONING SYSTEM

(75) Inventors: Toshiharu Nishizuka, Kyoto; Daisuke Tabata, Kusatsu; Yuji Takeda, Otsu, all of (JP); Naoko Oie, Westminster, CO (US)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/673,140

(22) PCT Filed: Oct. 4, 1999

(86) PCT No.: PCT/JP99/05483

§ 371 (c)(1),
(2), (4) Date: Oct. 11, 2000

(87) PCT Pub. No.: WO00/49343

PCT Pub. Date: Aug. 24, 2000

(30) Foreign Application Priority Data

Feb. 16, 1999 (JP) ..... 11-036571
Feb. 16, 1999 (JP) ..... 11-036572

(51) Int. Cl.[7] ..... F25B 7/00

(52) U.S. Cl. ..... 62/175; 62/230; 62/158; 62/228.5

(58) Field of Search ..... 62/230, 175, 157, 62/158, 228.5; 307/40, 41

(56) References Cited

U.S. PATENT DOCUMENTS 3,422,633 A * 1/1969 Bodett ..... 62/158
4,177,388 A * 12/1979 Lingenfelter ..... 307/38
4,749,881 A * 6/1988 Uhrich ..... 307/41
5,119,014 A * 6/1992 Kronberg ..... 323/267
5,216,897 A * 6/1993 Tsuchiyama ..... 62/158
5,365,747 A * 11/1994 Werbowsky et al. ..... 62/126
5,454,229 A * 10/1995 Hanson et al. ..... 62/126
5,524,448 A * 6/1996 Schwanebeck et al. ..... 62/231
5,782,098 A * 7/1998 Hirooka et al. ..... 62/126
6,119,469 A * 9/2000 Elwood ..... 62/126
6,216,479 B1 * 4/2001 Elwood ..... 62/230

FOREIGN PATENT DOCUMENTS

JP 4-257674 9/1992
JP 4-363535 12/1992
JP 5-322260 12/1993
JP 7-208789 8/1995
JP 10-19338 1/1998

* cited by examiner

*Primary Examiner*—Denise L. Esquivel
*Assistant Examiner*—Marc Norman
(74) *Attorney, Agent, or Firm*—Parkhurst & Wendel, LLP

(57) ABSTRACT

It is an object of the present invention to provide an operation control method of an air-conditioning apparatus and an air-conditioning apparatus that prevent a plurality of air-conditioning apparatuses from simultaneously restarting upon their automatic recovery after a recovery of power and from stopping again due to a voltage drop. The air-conditioning apparatus of the present invention is provided with an automatic recovery control circuit (21) for deciding a delay time until a restart based on set data for deciding operation works of the air-conditioning apparatus or randomly, thereby to restart the air-conditioning apparatus with the decided delay time.

12 Claims, 11 Drawing Sheets

OPERATION CONTROL METHOD FOR AIR CONDITIONING SYSTEM AND AIR CONDITIONING SYSTEM

FIELD OF THE INVENTION

The present invention relates to an air-conditioning apparatus that performs indoor air-conditioning.

BACKGROUND OF THE INVENTION

There are various types of conventional air-conditioning apparatus such as an air-conditioning apparatus incorporating an indoor unit and outdoor unit as one body and a separate type air-conditioning apparatus with an indoor unit separate from an outdoor unit. Here, this separate type air-conditioning apparatus will be explained as a specific example below.

As shown in FIG. 15, a conventional separate type air-conditioning apparatus capable of air-conditioning operation is configured by an indoor unit 1, an outdoor unit 2 and indoor and outdoor connecting electric wires 3 that electrically connect the indoor and outdoor units. This indoor unit 1 is configured by a main switch 4, an indoor electronic control apparatus 5, an indoor fan motor 6 such as a transistor motor and an indoor upper/lower blade drive louver motor 7. On the other hand, the outdoor unit 2 is configured by an outdoor electronic control apparatus 8, a four-way valve 9 that switches the path of a coolant according to a cooling cycle and heating cycle, an outdoor fan motor 10 such as an induction motor and a compressor 11 that compresses the coolant.

The operation of this separate type air-conditioning apparatus will be explained below. The indoor unit 1 is connected with a commercial power supply 12 and when the main unit switch 4 of the indoor unit 1 is turned on, power is supplied to the indoor electronic control apparatus 5 and a control operation is started, making the indoor fan motor 6 and louver motor 7 run and starting to circulate the indoor air through an indoor heat exchanger (not shown in the figure). Here, when the user instructs the start of operation through signal input, the indoor electronic control apparatus 5 controls a main relay (not shown in the figure) to close the circuit and supply the commercial power supply 12 to the outdoor unit 2. At this time, power is supplied from the commercial power supply 12 to the outdoor electronic control apparatus 8, which makes the outdoor electronic control apparatus 8 start a control operation, applies a specified voltage to the compressor 11, makes the compressor 11 start to run, connects the commercial power supply 12 also to the outdoor fan motor 10, starting, as a result, to blow the outdoor air into an outdoor heat exchanger (not shown in the figure). Under the instruction of the outdoor electronic control apparatus 8, the four-way valve 9 that switches the path of the coolant is in the position to flow the coolant through the cooling cycle path when the commercial power supply 12 is not connected. In this condition, the air-conditioning apparatus starts a cooling operation.

Next, when the user instructs a heating operation through signal input, the outdoor electronic control apparatus 8 connects the commercial power supply 12 to the four-way valve 9. This operation switches the coolant path to a heating cycle and a heating operation starts. At this time, the outdoor fan motor 10 blows the outdoor air into the outdoor heat exchanger and heat of the outdoor air is introduced to the coolant by the outdoor heat exchanger and the coolant is vaporized, compressed by the compressor 11 and sent to the indoor heat exchanger.

For example, if the indoor unit 1 and outdoor unit 2 which are performing a cooling operation or heating operation as described above are stopped due to a power failure and recovered from this power failure, the indoor electronic apparatus 5 restarts the system in a specified time to keep a pressure balance of the compressor 11 so that the system automatically recovers in its operation mode before the power failure.

However, the conventional air-conditioning apparatus has a uniformly set specified time to keep a pressure balance of the compressor, and therefore if in a household, factory or office where a plurality of the aforementioned air-conditioning apparatuses with auto recovery control, these air-conditioning apparatuses are stopped due to a power failure and then recovered from the power failure and restarted by auto recovery control, the plurality of the air-conditioning apparatuses are restarted when it is detected that the specified time has elapsed, which provokes a problem that due to an instantaneous voltage drop of the commercial power supply the air-conditioning apparatuses are stopped again.

DISCLOSURE OF THE INVENTION

It is an object of the present invention to provide an air-conditioning apparatus operation control method and an air-conditioning apparatus that will prevent a plurality of air-conditioning apparatuses from simultaneously restarting upon automatic recovery after a recovery of power and from being stopped again due to a voltage drop. To attain this object, the air-conditioning apparatus operation control method of the present invention makes a plurality of air-conditioning apparatuses discretely restart upon recovery of power, and in particular discretely restart with random delay times, thereby making it possible to prevent the air-conditioning apparatuses from stopping again due to a voltage drop caused when the plurality of air-conditioning apparatuses simultaneously restart at the time of automatic recovery after the recovery of power.

When a plurality of air-conditioning apparatuses stopped by a power failure are automatically recovered in an operation mode before the power failure, the operation control method of the present invention adopts an air-conditioning apparatus operation control method that makes the plurality of air-conditioning apparatuses restart discretely with different delay times or delay times varying among a number of groups of air-conditioning apparatuses at the time of recovery of power, making it possible to prevent the air-conditioning apparatuses from stopping again due to a voltage drop when the plurality of air-conditioning apparatuses simultaneously restart at the time of automatic recovery after the recovery of power.

Moreover, this operation control method adopts a method of randomly generating and deciding delay times until a restart of air-conditioning apparatuses and restarting those air-conditioning apparatuses with these decided delay times, providing an extremely high probability of discretely restarting a plurality of air-conditioning apparatuses.

Furthermore, when a plurality of air-conditioning apparatuses stopped by a power failure are automatically recovered in an operation mode before the power failure after recovery of power, this operation control method adopts an air-conditioning apparatus operation control method that decides delay times until a restart according to each corresponding air-conditioning load before the power failure or the operation state before the power failure, and restarts the air-conditioning apparatuses with the decided delay times, providing an extremely high probability of discretely restarting a plurality of air-conditioning apparatuses and providing an extremely high probability of avoiding a case where the air-conditioning apparatuses are stopped again due to a voltage drop when all air-conditioning apparatuses simultaneously restart.

Furthermore, this operation control method adopts an air-conditioning apparatus operation control method that decides again a delay time by further adding a randomly generated time to the delay time until the restart decided according to each own air-conditioning load before the power failure or operation state before the power failure and restarts the air-conditioning apparatuses with this delay time.

Furthermore, this operation control method is a method of changing delay times according to the length of power failure period, making it possible to effectively use the power failure period and shorten the time after the recovery of power of separate type air-conditioning apparatuses until their restart.

The air-conditioning apparatus of a first embodiment of the present invention automatically recovers in the operation mode before the power failure after recovery of power and is provided with detecting means for detecting set data that determines the operation of the air-conditioning apparatus, a calculation circuit that converts the set data from the detecting means to variables, a storage circuit that stores the set data from the detecting means and variable data from the calculation circuit, and a decision circuit that decides a delay time until a restart according to the variable data, and is capable of deciding the delay time until a restart of a separate type air-conditioning apparatus at the time of the recovery of power according to the set data before the power failure. An operation mode for automatically recovering a plurality of air-conditioning apparatuses that are stopped by a power failure in the operation mode before the power failure after the recovery of power provides an extremely high probability that a delay time until a restart will be determined according to each own set data of the air-conditioning apparatuses, and the plurality of air-conditioning apparatuses can be discretely restarted at the time of recovery of power and provides an extremely high probability of avoiding a case where all air-conditioning apparatuses are restarted simultaneously and stopped again due to an instantaneous voltage drop of a commercial power supply.

Furthermore, this air-conditioning apparatus is provided with a timer to measure a power failure period and the decision circuit is configured so that a delay time is changed according to the measured power period from the timer, making it possible to control the pressure balance condition of the compressor by measuring the power failure period, make full use of the stop period, shorten the time after the recovery of power until the restart of the separate type air-conditioning apparatus, and reduce a variation of the room temperature from the set temperature.

Furthermore, this air-conditioning apparatus has a calculation circuit configured so as to calculate the air-conditioning load based on the output from a room temperature detecting means for detecting a room temperature and the output from an outdoor air temperature detecting means for detecting an outdoor air temperature, and a decision circuit configured so as to correct a delay time based on the air-conditioning load, making it possible to define the air-conditioning load of the separate type air-conditioning apparatus by measuring the room temperature and outdoor air temperature, correct and optimize the delay time after the recovery of power until a restart of the separate type air-conditioning apparatus based on the air-conditioning load, and reduce a variation of the room temperature from the set temperature.

Furthermore, this air-conditioning apparatus has a calculation circuit configured so as to calculate the main unit load based on the set data stored in the recording circuit and the decision circuit configured so as to correct a delay time based on the main unit load, making it possible to use set data such as on the operation mode, the volume of air and the wind direction to define the main unit load of the separate type air-conditioning apparatus, correct and optimize a delay time from the recovery of power to restart of the separate type air-conditioning apparatus based on the main unit load, reduce the starting current of the separate type air-conditioning apparatus by optimizing the pressure balance state of the compressor, and reduce a voltage drop of the commercial power supply.

Furthermore, this air-conditioning apparatus has a calculation circuit configured so as to calculate the main unit load based on the set data stored in the storage circuit and the decision circuit configured so as to correct a delay time based on the main unit load, making it possible to define the main unit load of the separate type air-conditioning apparatus by using set data such as on the operation mode, volume of air and wind direction, correct and optimize a delay time from the recovery of power to restart the separate type air-conditioning apparatus based on the main unit load, reduce the starting current of the separate type air-conditioning apparatus by optimizing the pressure balance state of the compressor, and reduce a voltage drop of the commercial power supply.

Furthermore, this air-conditioning apparatus has a calculation circuit configured so as to calculate the main unit load based on the room temperature detected by the room temperature detecting means and the set temperature stored in the storage circuit, and the decision circuit configured so as to correct a delay time based on the main unit load, so that it is possible, with the room temperature and set temperature, to consider the operation cases with the thermostat turned OFF or with varied operation frequencies of the separate type air-conditioning apparatus. Thus, it is possible to define the main unit load more clearly, correct to optimally minimize the delay time from the recovery of power to the restart of the separate type air-conditioning apparatus based on the main unit load, reduce the starting current of the separate type air-conditioning apparatus by optimizing the pressure balance state of the compressor, reduce a voltage drop of the commercial power supply, and reduce a variation of the room temperature from the set temperature. An operation mode of automatically recovering a plurality of air-conditioning apparatuses that are stopped by a power failure in the operation mode before the power failure after a recovery of power provides an extremely high probability that each air-conditioning apparatus will correct and decide the delay time until a restart based on the main unit load and discretely restart a plurality of air-conditioning apparatuses at the time of recovery of power and provides an extremely high probability of avoiding a case where all air-conditioning apparatuses are restarted simultaneously and stopped again due to an instantaneous voltage drop of a commercial power supply.

The air-conditioning apparatus of a second embodiment of the present invention automatically recovers in the operation mode before the power failure and is provided with detecting means for detecting set data that decides the operation of the air-conditioning apparatus, a calculation circuit that generates random number data when a command is received from the detecting means, a storage circuit that stores the set data from the detecting means and random number data from the calculation circuit and a decision circuit that decides a delay time until a restart according to the random number data, and is capable of deciding the delay time until a restart of the separate type air-conditioning apparatus at the time of recovery of power according to the random number data.

Furthermore, as in the case of the air-conditioning apparatus according to the first embodiment, this air-conditioning apparatus is provided with a timer to measure the power failure period, and the decision circuit is configured so as to change a delay time according to the power measurement period from the timer.

Furthermore, as in the case of the air-conditioning apparatus according to the first embodiment, this air-conditioning apparatus has a calculation circuit configured so as to calculate the air-conditioning load based on the output from the room temperature detecting means for detecting the room temperature and the output from the outdoor air temperature detecting means for detecting the outdoor air temperature, and a decision circuit is configured so as to correct a delay time based on the air-conditioning load.

Furthermore, as in the case of the air-conditioning apparatus according to the first embodiment, this air-conditioning apparatus has a calculation circuit configured so as to calculate the main unit load based on the set data stored in the storage circuit, and a decision circuit is configured so as to correct a delay time based on the main unit load.

Furthermore, as in the case of the air-conditioning apparatus according to the first embodiment, this air-conditioning apparatus has a calculation circuit configured so as to calculate the main unit load based on the room temperature detected by the room temperature detecting means and the set temperature stored in the storage circuit, and a decision circuit is configured so as to correct a delay time based on the main unit load.

EMBODIMENTS

With reference to the attached drawings, the air-conditioning apparatus operation control method and the air-conditioning apparatus of the present invention will be explained based on specific embodiments below.

Embodiment 1

Figure 1:
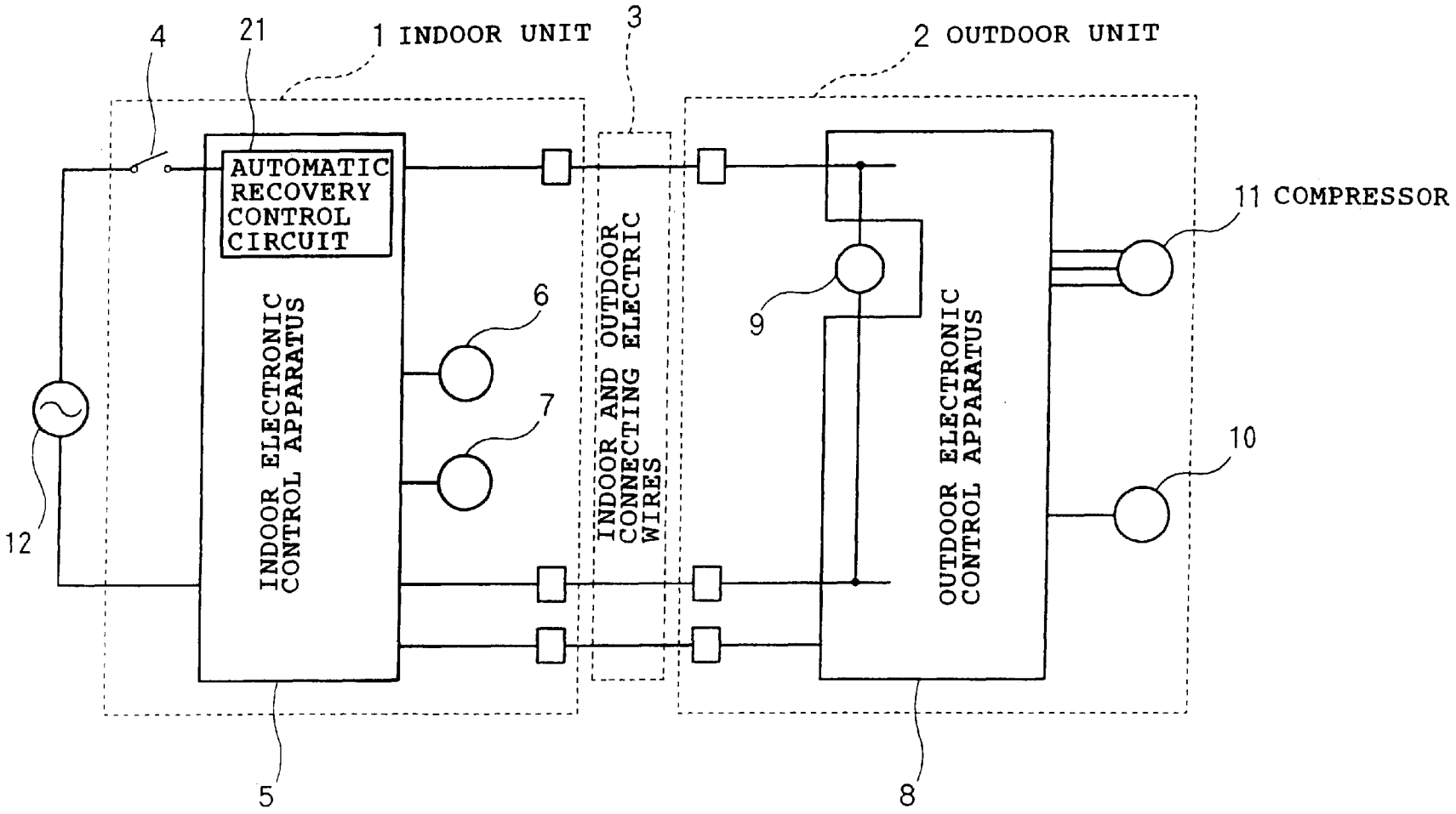
FIG. 1 is a block diagram showing a configuration of a separate type air-conditioning apparatus according to Embodiment 1 of the present invention.
Figure 15:
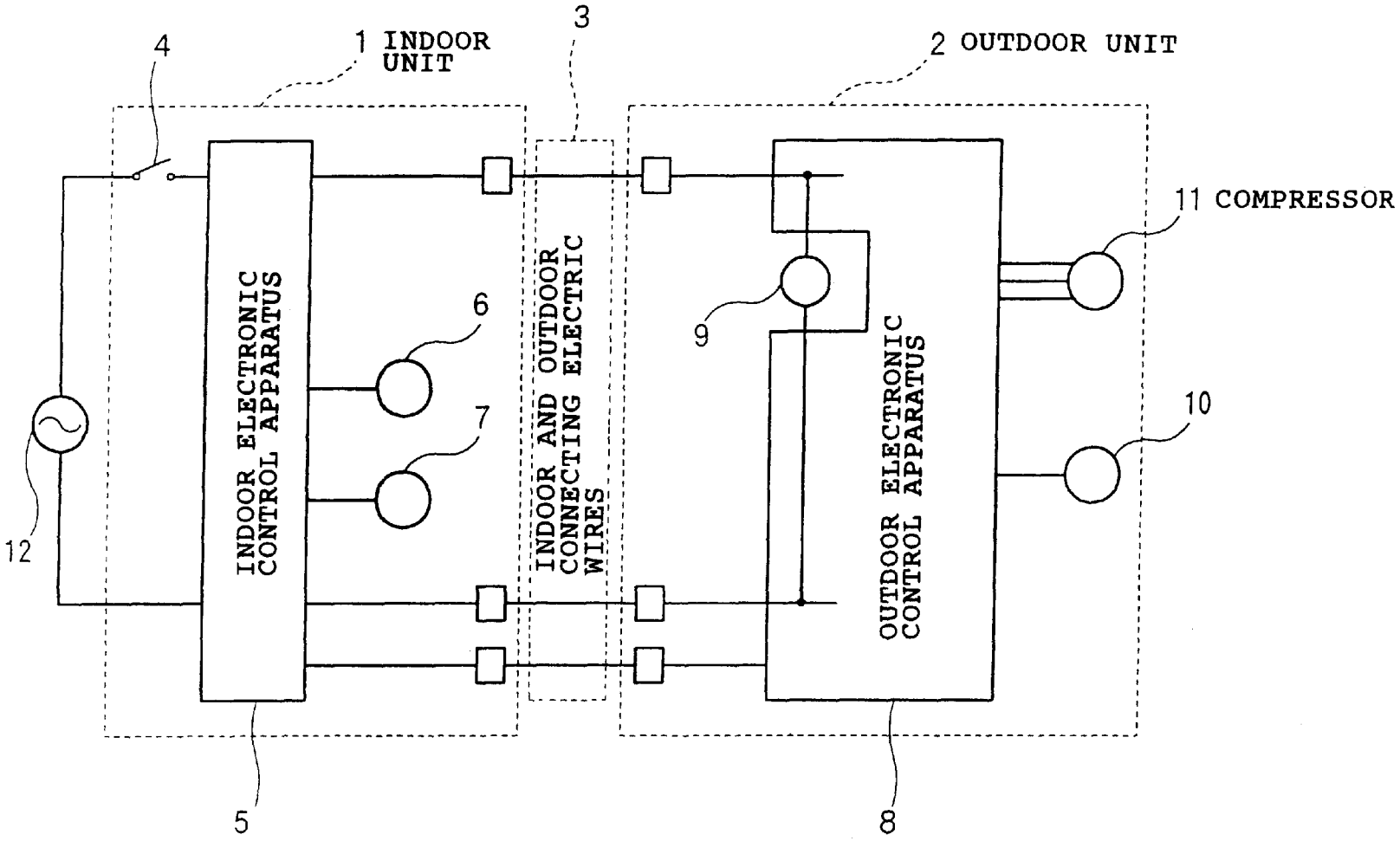
FIG. 15 is a block diagram showing a configuration of a conventional separate type air-conditioning apparatus.

As in the case of the conventional example shown in FIG. 15, the air-conditioning apparatus of Embodiment 1 shown in FIG. 1 is a separate type air-conditioning apparatus configured by an indoor unit 1 and an outdoor unit 2 and indoor and outdoor connecting electric wires 3 that connect these apparatuses and is different from the conventional example only in that an automatic recovery control circuit 21 is added.

Figure 2:
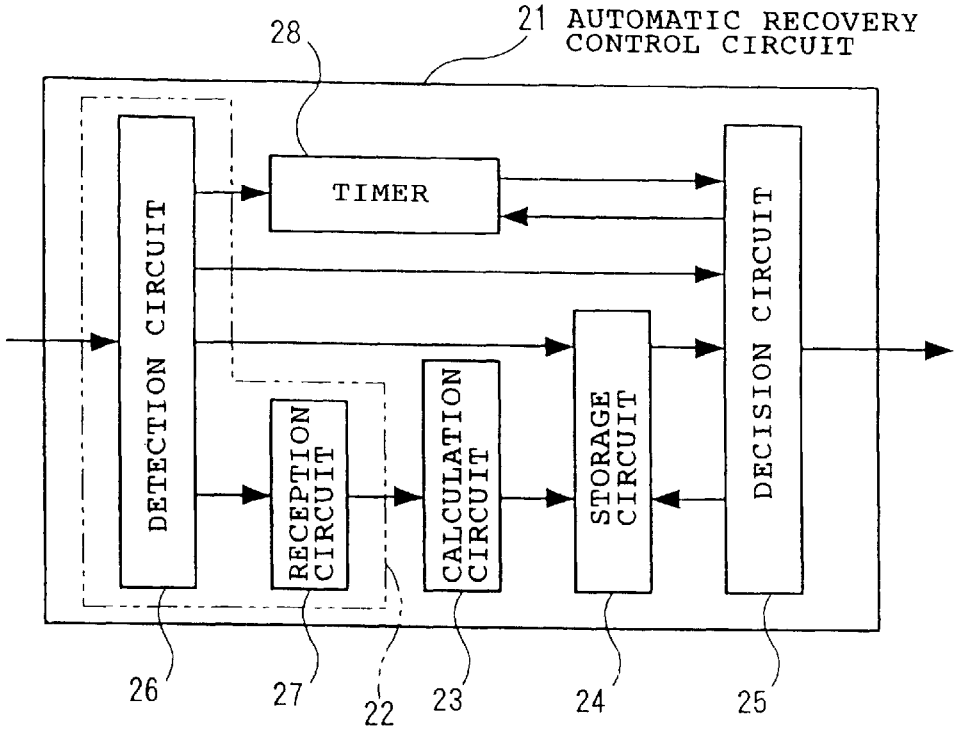
FIG. 2 is a block diagram showing a configuration of an automatic recovery control circuit according to Embodiment 1 of the present invention.

The automatic recovery control circuit 21 operates after recovery of power so that the air-conditioning apparatus automatically recovers in the operation mode before the power failure, and more specifically is configured as shown in FIG. 2 and power necessary for the operation of this automatic recovery control circuit 21 is normally backed by a capacitor charged during operation.

This automatic recovery control circuit 21 is configured by a detecting means 22 for detecting set data that decides the operation of the air-conditioning apparatus, a calculation circuit 23 that converts the set data from the detecting means 22 to variables, a storage circuit 24 that stores the set data from the detecting means 22 and variable data from the calculation circuit 23, a decision circuit 25 that decides a delay time until a restart according to the variable data and a timer 28 that measures a power failure period. The detecting means 22 is configured by a detection circuit 26 and a reception circuit 27.

Here, the operation of this separate type air-conditioning apparatus will be explained below.

During a normal operation, the detection circuit 26 detects the set data transmitted from a remote controller (not shown in the figure) during a normal operation and used by the separate type air-conditioning apparatus for operation and the reception circuit 27 receives this set data as a set data signal.

The calculation circuit 23 converts the set data from the reception circuit 27 to variables. The calculation circuit 23 converts set data (explanation will be made for a case in which, for example, cooling operation: 1, maximum volume of air: 1, automatic air director: 3, set temperature 16° C.: 2) to variables and calculates it as 1+1+3+2=7 and outputs "7" as variable data in this case. The storage circuit 24 stores this set data and variable data.

In the case where the separate type air-conditioning apparatus stops due to a power failure, the detecting means 22 detects information indicating the occurrence of a power failure and the timer 28 is activated.

Then, when power is recovered, the detecting means 22 detects information that power has been recovered and the storage circuit 24 and decision circuit 25 decide whether the own separate type air-conditioning apparatus was operating or not before the power failure. In the case where the separate type air-conditioning apparatus was not operating before the power failure, no automatic recovery is instructed. On the other hand, in the case where the separate type air-conditioning apparatus was operating before the power failure, the separate type air-conditioning apparatus is restarted according to the set data stored in the storage circuit 24 and automatically recovers so that the own separate type air-conditioning apparatus restarts the operation under the same condition as that before the power failure.

Here, the automatic recovery operation will be explained.

At the time of recovery of power, the decision circuit 25 reads the power failure period from the timer 28 and judges whether this power failure period is within a specified time necessary for the pressure balance of the compressor 11.

In the case where the decision circuit 25 decides that the power failure period is shorter than the specified time, the decision circuit 25 uses the variable data stored in the storage circuit 24 and decides time Ti obtained by multiplying this variable data by, for example, 10 then added to specified time T0 necessary for the pressure balance of the compressor 11, that is, time (T0+T1) as a delay time until a restart and when a lapse of this delay time (T0+T1) after recovery of power is detected, the own separate type air-conditioning apparatus is restarted and automatic recovery is performed. More specifically, in the case where the variable data is "7," a restart is performed after T0+(70 sec).

In the case where the decision circuit 25 decides that the power failure period is shorter than the specified time, the decision circuit 25 uses the variable data stored in the storage circuit 24 and decides time T1 obtained by multiplying this variable data by, for example, 10 as a delay time until a restart and when a lapse of this delay time T1 after recovery of power is detected, the own separate type air-conditioning apparatus is restarted and automatic recovery is performed. More specifically, in the case where the variable data is "7," a restart is performed after 70 seconds.

With this configuration, it is possible to decide the delay time until the restart of the separate type air-conditioning apparatus at the time of recovery of power according to the set data before the power failure.

An operation mode of automatically recovering a plurality of air-conditioning apparatuses that are stopped by a power failure in the operation mode before the power failure after recovery of power provides an extremely high probability that each air-conditioning apparatus can decide a delay time until a restart according to its own set data and a plurality of air-conditioning apparatuses can be discretely restarted at the time of recovery of power, and provides an extremely high probability of avoiding a case where all air-conditioning apparatuses are restarted simultaneously and stopped again due to an instantaneous voltage drop of the commercial power supply 12.

Furthermore, since the decision circuit 25 is configured so as to change the delay time until a restart according to the power failure measurement period from the timer 28, it is possible to control the pressure balance state of the compressor 11 by measurement of the power failure period and change the delay time to T0+T1 or only T1 according to the stop period, thereby shorten the time from the recovery of power to the restart of the separate type air-conditioning apparatus and reduce a variation of the room temperature from the set temperature.

Embodiment 2

Figure 4:
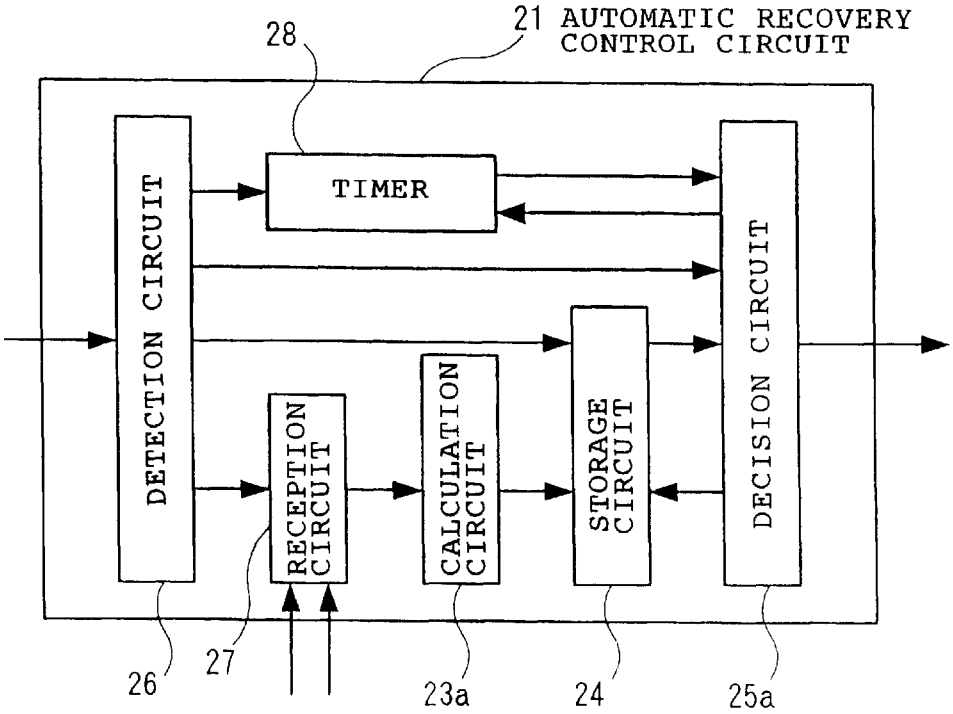
FIG. 4 is a block diagram showing a configuration of an automatic recovery control circuit according to Embodiment 2 of the present invention.
Figure 3:
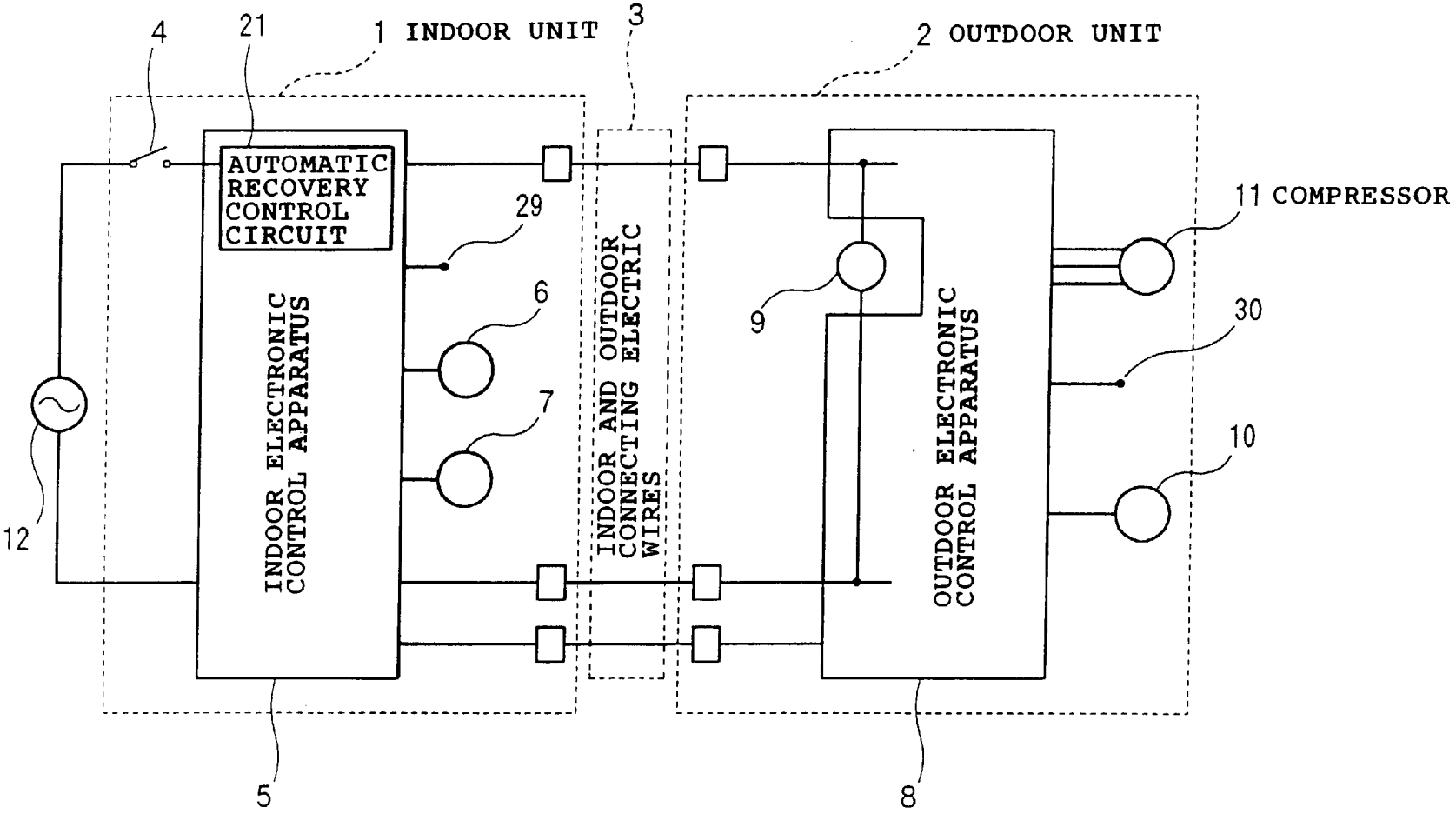
FIG. 3 is a block diagram showing a configuration of a separate type air-conditioning apparatus according to Embodiment 2 of the present invention.

As shown in FIG. 3, the air-conditioning apparatus according to Embodiment 2 of the present invention comprises the aforementioned separate type air-conditioning apparatus of Embodiment 1 further equipped with a room temperature detecting means 29 such as an suction temperature sensor for detecting the room temperature and an outdoor air temperature detecting means 30 such as an outdoor air temperature sensor for detecting the outdoor air temperature and, as shown in FIG. 4, is different in that a calculation circuit 23*a* is configured with a function of calculating the air-conditioning load based on the output from the room temperature detecting means 29 and outdoor air temperature detecting means 30 added to the aforementioned calculation circuit 23 of Embodiment 1 and a decision circuit 25*a* is configured with a function of correcting a delay time based on the air-conditioning load added to the aforementioned decision circuit 25 of Embodiment 1.

The room temperature detecting means 29 is connected with a reception circuit 27 of an automatic recovery control circuit 21 via an indoor electronic control apparatus 5 of an indoor unit 1 and the outdoor air temperature detecting means 30 is connected with the reception circuit 27 of the automatic recovery control circuit 21 via an outdoor electronic control apparatus 8 of an outdoor unit 2.

Here, the automatic recovery operation of this separate type air-conditioning apparatus will be explained below.

The reception circuit 27 receives a room temperature detection signal, which is the room temperature detected by the room temperature detecting means 29 and an outdoor air temperature detection signal which is the outdoor air temperature detected by the outdoor air temperature detecting means 30.

The calculation circuit 23*a* calculates an air-conditioning load of the own separate type air-conditioning apparatus based on the room temperature detection signal from the room temperature detecting means 29 and the outdoor air detection signal output from the outdoor air temperature detecting means 30.

The storage circuit 24 stores the air-conditioning load calculated by the calculation circuit 23*a*. This storage circuit 24 also stores a data table that lists the correction time corresponding to the magnitude of the air-conditioning load in a table form.

At the time of recovery of power, the decision circuit 25*a* finds the correction time corresponding to the air-conditioning load read from the storage circuit 24 by searching from the data table, corrects specified time T0 which is the time necessary for the pressure balance of the compressor 11 with the correction time and calculates specified time T2 after the correction.

It is also possible to configure this decision circuit 25*a* so as to correct time T1 corresponding to the set data or correct both time T1 and specified time T0 with the correction time.

Then, the decision circuit 25*a* reads a power failure period from the timer 28 and decides whether this stop period is shorter than the specified time (T2) after the correction or not.

In the case where the decision circuit 25*a* decides that the power failure period is shorter than the specified time (T2) after the correction, the decision circuit 25*a* decides specified time T2 after the correction plus time T1, that is (T2+T1), as a delay time until a restart and when a lapse of this delay time (T2+T1) after the recovery of power is detected, the own separate type air-conditioning apparatus is restarted and automatic recovery is performed.

In the case where the decision circuit 25*a* decides that the power failure period is beyond the specified time (T2) after the correction, the decision circuit 25*a* decides only time T1 as a delay time until a restart and when a lapse of delay time T1 after the recovery of power is detected, the own separate type air-conditioning apparatus is restarted and automatic recovery is performed.

Measuring a room temperature and outdoor air temperature makes it possible to define the air-conditioning load of the separate type air-conditioning apparatus, correct and optimize a delay time after recovery of power until a restart of the separate type air-conditioning apparatus based on the air-conditioning load and reduce a variation of the room temperature from the set temperature.

Embodiment 3

Figure 5:
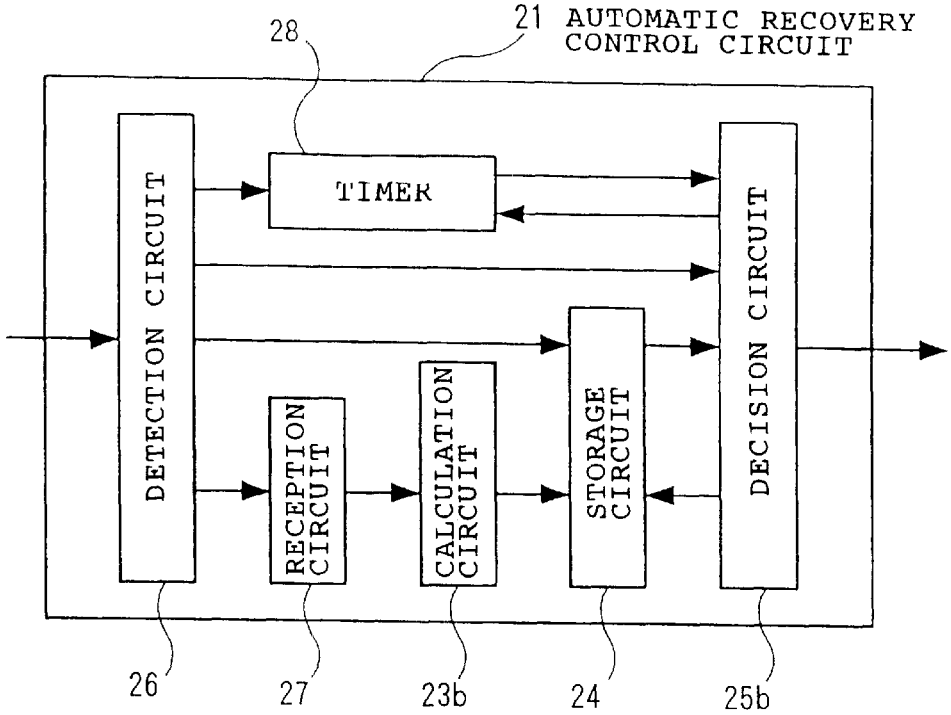
FIG. 5 is a block diagram showing a configuration of an automatic recovery control circuit according to Embodiment 3 of the present invention.

The air-conditioning apparatus according to Embodiment 3 of the present invention, as shown in FIG. 5, is different in that a calculation circuit 23*b* is configured with a function of calculating the main unit load based on the set data stored in the storage circuit 24 added to the calculation circuit 23 of Embodiment 1 above and a decision circuit 25*b* is configured with a function of correcting a delay time based on the main unit load added to the decision circuit 25 of Embodiment 1 above.

Here, the automatic recovery operation of the separate type air-conditioning apparatus will be explained below.

The calculation circuit 23*b* calculates the main unit load of the separate type air-conditioning apparatus based on set data such as operation mode, volume of air and wind direction data stored in the storage circuit 24. The main unit load of this separate type air-conditioning apparatus includes not only the air-conditioning load but also operation load such as the indoor fan motor 6, louver motor 7 and outdoor fan motor 10, which are the components of the separate type air-conditioning apparatus.

The storage circuit 24 stores the main unit load calculated by the calculation circuit 23*b*. This storage circuit 24 also stores a data table that lists the correction time corresponding to the magnitude of the main unit load in a table form.

At the time of recovery of power, the decision circuit 25*b* finds the correction time corresponding to the main unit load read from the storage circuit 24 by searching from the data table, corrects specified time T0 which is the time necessary for the pressure balance of the compressor 11 with the correction time and calculates specified time T3 after the correction.

It is also possible to configure the decision circuit 25*b* so as to correct time T1 corresponding to the set data or correct both time T1 and specified time T0 with the correction time.

Then, the decision circuit 25*b* reads a power failure period from the timer 28 and decides whether this stop period is shorter than the specified time (T3) after the correction or not.

In the case where the decision circuit 25*b* decides that the power failure period is shorter than the specified time (T3) after the correction, the decision circuit 25*b* decides specified time T3 after the correction plus time T1, that is (T3+T1), as a delay time until a restart and when a lapse of this delay time (T3+T1) after the recovery of power is detected, the own separate type air-conditioning apparatus is restarted and automatic recovery is performed.

In the case where the decision circuit 25*b* decides that the power failure period is beyond the specified time (T3) after the correction, the decision circuit 25*b* decides only time T1 as a delay time until a restart and when a lapse of delay time T1 after the recovery of power is detected, the own separate type air-conditioning apparatus is restarted and automatic recovery is performed.

Using set data such as operation mode, volume of air and wind direction makes it possible to define the air-conditioning load of the separate type air-conditioning apparatus, correct and optimize a delay time after the recovery of power until a restart of the separate type air-conditioning apparatus based on the main unit load, reduce the starting current of the separate type air-conditioning apparatus by optimizing the pressure balance state of the compressor 11 and reduce a voltage drop of the commercial power supply 12.

Embodiment 4

Figure 6:
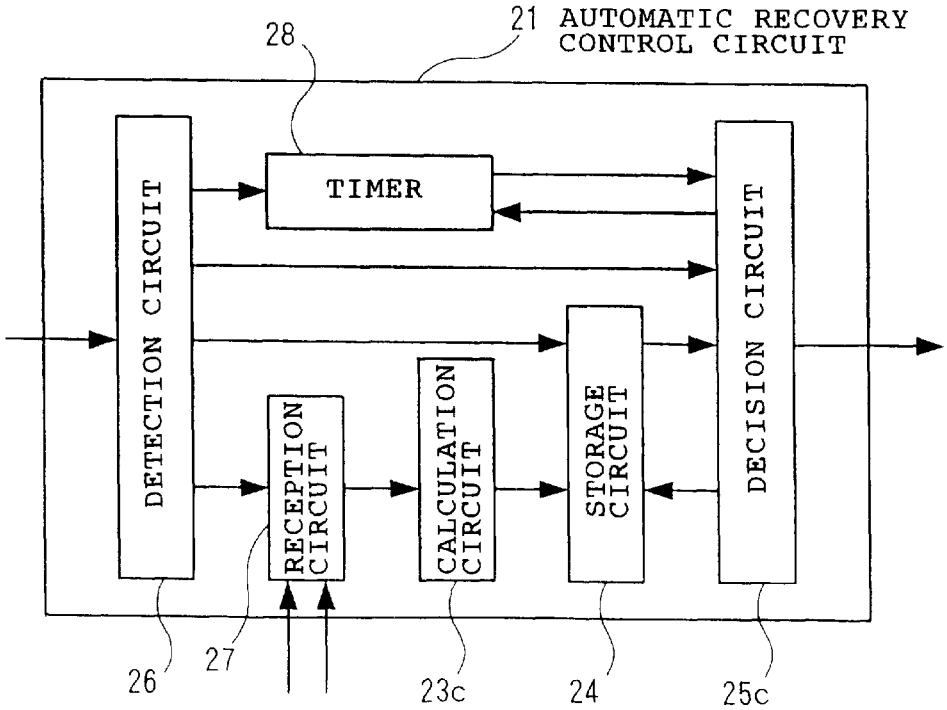
FIG. 6 is a block diagram showing a configuration of an automatic recovery control circuit according to Embodiment 4 of the present invention.

The air-conditioning apparatus according to Embodiment 4 of the present invention is also provided with the room temperature detecting means 29 shown in Embodiment 2 above and is, as shown in FIG. 6, different in that a calculation circuit 23*c* is configured with a function of calculating the main unit load based on the room temperature detected by the room temperature detecting means 29 and the set temperature stored in the storage circuit 24 added to the aforementioned calculation circuit 23 of Embodiment 1 and a decision circuit 25*c* is configured with a function of correcting a delay time based on the above described main unit load added to the aforementioned decision circuit 25 of Embodiment 1.

Here, the automatic recovery operation of this separate type air-conditioning apparatus will be explained below.

The calculation circuit 23*c* calculates the main unit load by calculating the operating state (thermostat OFF, operation frequency variation, etc.) of the separate type air-conditioning apparatus based on the room temperature detection signal detected by the room temperature detecting means 29 and the set room temperature data stored in the storage circuit 24.

The storage circuit 24 stores the main unit load calculated by the calculation circuit 23*c*. This storage circuit 24 also stores a data table that lists the correction time corresponding to the magnitude of the main unit load in a table form.

At the time of recovery of power, the decision circuit 25*c* finds the correction time corresponding to the main unit load read from the storage circuit 24 by searching from the data table, corrects specified time T0, which is the time necessary for the pressure balance of the compressor 11, with the above correction time and calculates specified time T4 after the correction.

It is also possible to configure the decision circuit 25*c* so as to correct time T1 corresponding to the above set data or both T1 and specified time T0 with the aforementioned correction time.

Then, the decision circuit 25*c* reads the power failure period from the timer 28 and judges whether this power failure period is within a specified time (T4) after the correction.

In the case where the decision circuit 25*c* decides that the power failure period is shorter than the specified time (T4), the decision circuit 25*c* decides time T1 added to specified time T4 after the correction, that is, (T4+T1) as a delay time until a restart and when a lapse of this delay time (T4+T1) after recovery of power is detected, the own separate type air-conditioning apparatus is restarted and automatic recovery is performed.

In the case where the decision circuit 25*c* decides that the power failure period is equal to or longer than the specified time (T4), the decision circuit 25*c* decides only time T1 as a delay time until a restart and when a lapse of this delay time Ti after recovery of power is detected, the own separate type air-conditioning apparatus is restarted and automatic recovery is performed.

Controlling the room temperature and set temperature makes it possible, with the room temperature and set temperature, to consider the operation cases with the thermostat turned OFF or with varied operation frequencies of the separate type air-conditioning apparatus. Thus, it is possible to define the main unit load more clearly, correct, optimally minimize the delay time from the recovery of power to a restart of the separate type air-conditioning apparatus based on the main unit load, reduce the starting current of the separate type air-conditioning apparatus by optimizing the pressure balance state of the compressor 11, reduce a voltage drop of the commercial power supply, and reduce a variation of the room temperature from the set temperature.

Embodiment 5

Figure 7:
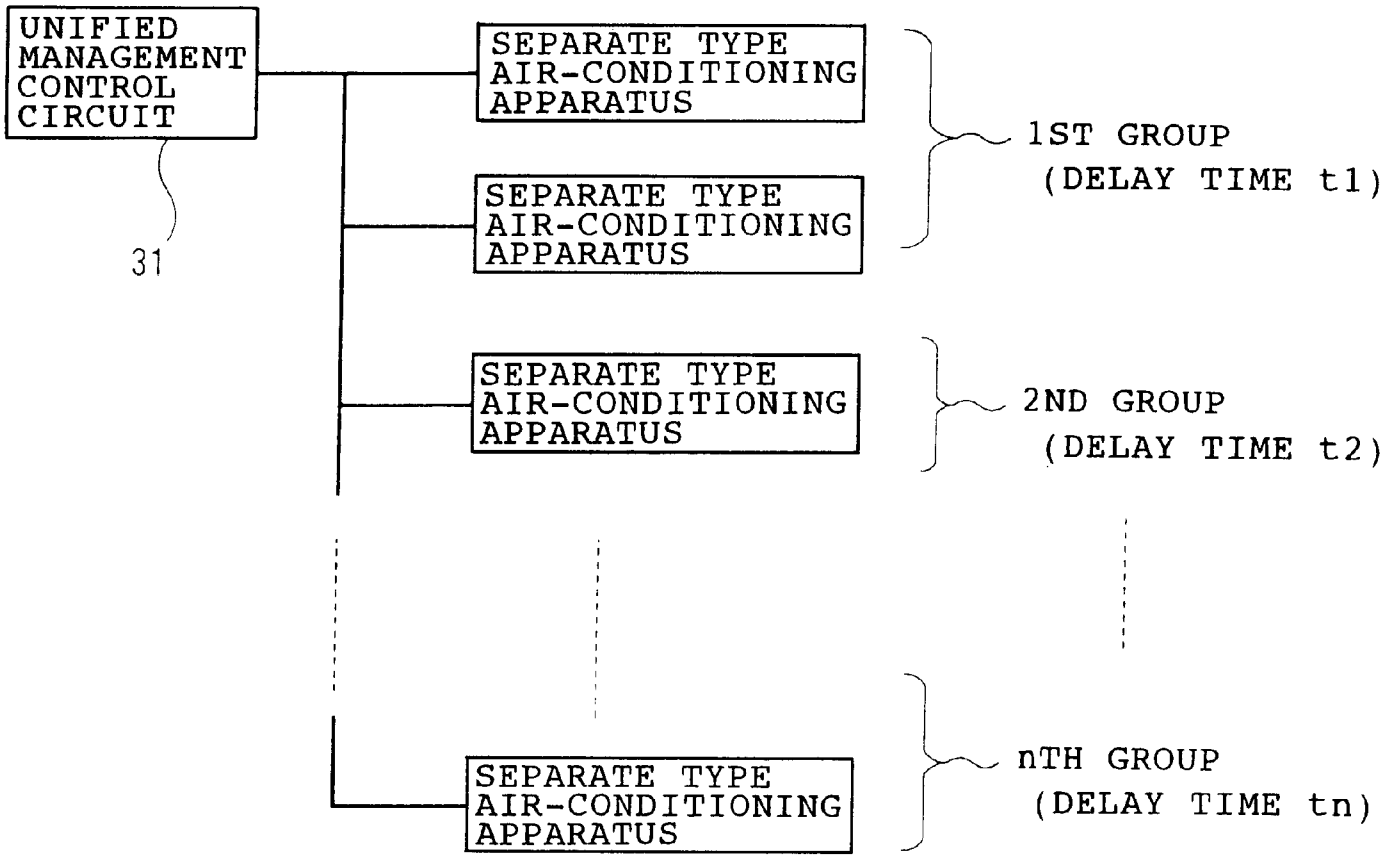
FIG. 7 is a block diagram showing a use example of a unified management control circuit according to Embodiment 5 of the present invention.

The air-conditioning apparatus of Embodiment 5 of the present invention is different in that as shown in FIG. 7, a unified management control apparatus 31 is provided that instructs a plurality of separate type air-conditioning apparatuses to have delay times t1 to tn varying among a number of groups. For example, the lengths of delay times t1 to tn are decided based on the set data of one representative apparatus of the above group and t1 to tn are expected to be automatically set at different times.

The unified management control apparatus 31 separates a plurality of separate type air-conditioning apparatuses into a number of groups and indicates a delay time decided based on the set data of one representative apparatus of each group to the separate type air-conditioning apparatuses of the same group.

More specifically, the first group is configured by two separate type air-conditioning apparatuses and the unified management control apparatus 31 reads delay time t1, which is decided based on the set data of one representative apparatus of the two and indicates delay time t1 to the two separate type air-conditioning apparatuses of the first group. The second group is configured by one separate type air-conditioning apparatus and the unified management control apparatus 31 reads delay time t2, which is decided based on the set data of this separate type air-conditioning apparatus and indicates the delay time t2 to this separate type air-conditioning apparatuses of the second group. In this way, the unified management control apparatus 31 indicates a delay time for each of up to n groups.

Each separate type air-conditioning apparatus stores a delay time indicated by the unified management control apparatus 31.

In the case where each separate type air-conditioning apparatus stops in the event of a power failure, each separate type air-conditioning apparatus restarts and performs an automatic recovery when a lapse of the own delay time indicated by the unified management control apparatus 31 and stored is detected.

More specifically, the two separate type air-conditioning apparatuses of the first group restart and perform an automatic recovery when a lapse of delay time t1 from the recovery of power to a restart is detected, the one separate type air-conditioning apparatus of the second group restarts and performs an automatic recovery when a lapse of delay time t2 from the recovery of power to a restart is detected, and the m separate type air-conditioning apparatuses of the nth group restart and perform an automatic recovery when a lapse of delay time tn from the recovery of power to restart is detected.

This configuration provides an extremely high probability that a plurality of separate type air-conditioning apparatuses will be restarted discretely in a number of groups with different delay times and provides an extremely high probability of avoiding a case where all separate type air-conditioning apparatuses are restarted simultaneously and then stopped again due to an instantaneous voltage drop of the commercial power supply 12.

This Embodiment 5 provides the unified management control apparatus 31 that instructs a plurality of separate type air-conditioning apparatuses to have delay times t1 to tn varying among a number of groups, but it is also possible to configure a plurality of separate type air-conditioning apparatuses so as to restart discretely with different delay times and make the unified management control apparatus 31 control each of the separate type air-conditioning apparatuses separately instead of separating the apparatuses into a number of groups and restart those apparatuses discretely.

Embodiment 6

Figure 8:
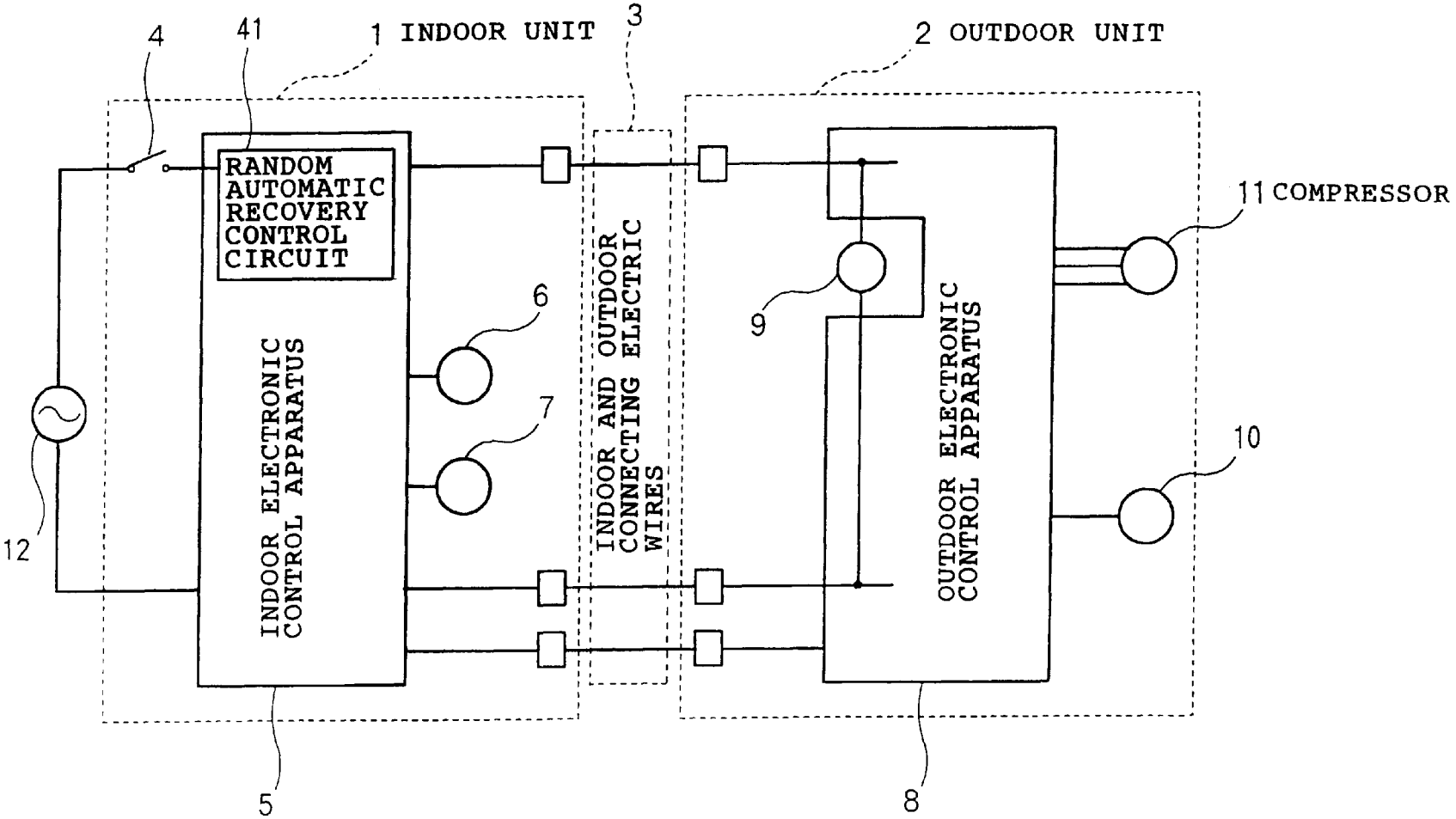
FIG. 8 is a block diagram showing a configuration of a separate type air-conditioning apparatus according to Embodiment 6 of the present invention.

The air-conditioning apparatus according to Embodiment 6 shown in FIG. 8 is a separate type air-conditioning apparatus configured by an indoor unit 1, an outdoor unit 2 and indoor and outdoor connecting electric wires 3 that connect these apparatuses as in the case of the conventional example shown in FIG. 15 and is only different from the conventional example in that a random automatic recovery control circuit 41 is added as an automatic recovery control circuit.

Figure 9:
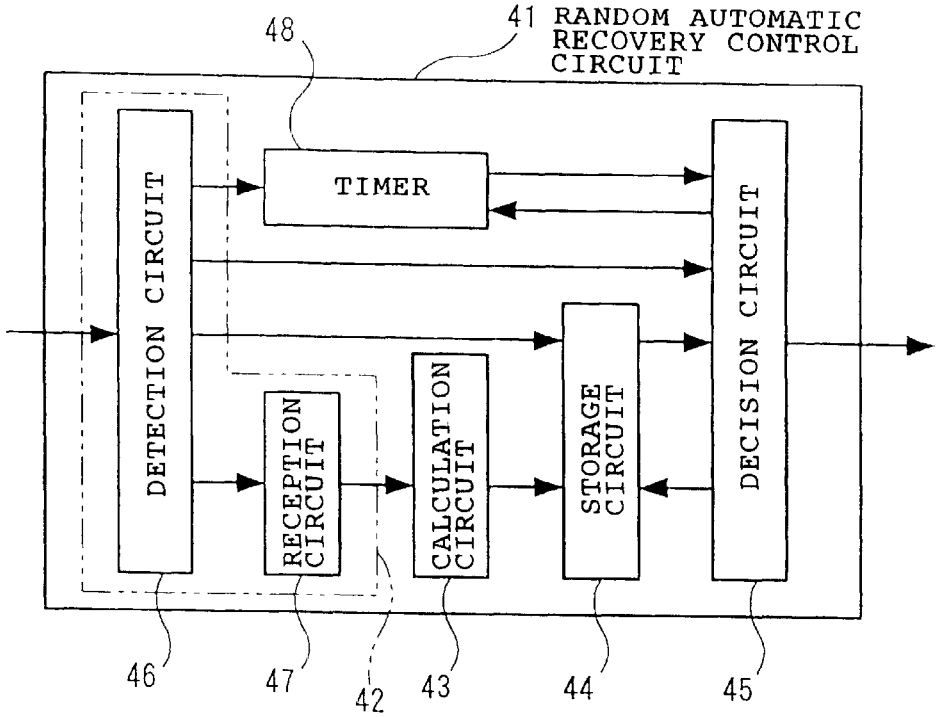
FIG. 9 is a block diagram showing a configuration of a random automatic recovery control circuit according to Embodiment 6 of the present invention.

The random automatic recovery control circuit 41 operates so that the apparatus automatically recovers in the operation mode before the power failure after a recovery of power and, more specifically, is configured as shown in FIG. 9 and the power necessary for operation of this random automatic recovery control circuit 41 is backed by a capacitor, etc. that is charged during a normal operation.

This random automatic recovery control circuit 41 is configured by a detecting means 42 for detecting the set data that decides the operation of the air-conditioning apparatus, a calculation circuit 43 that generates random number data upon reception of a command from the detecting means 42, a storage circuit 44 that stores the set data from the detecting means 42 and the random number data from the calculation circuit 43, a decision circuit 45 that decides a delay time until a restart according to the random number data and a timer 48 that measures a power failure period. The detecting means 42 is configured by a detection circuit 46 and a reception circuit 47.

Here, the operation of this separate type air-conditioning apparatus will be explained below.

During a normal operation, the detection circuit 46 detects the set data transmitted from a remote controller (not shown in the figure) and used by the separate type air-conditioning apparatus for operation, and the reception circuit 47 receives this set data as a set data signal.

Upon receipt of a random number generation command output when the detection circuit 46 detects the set data as a command from detecting means 42, the calculation section 43 generates random numbers (for example, 0 to 9) and outputs an extracted random number (for example, 5). The storage circuit 44 stores the set data detected by the detection circuit 46 and random number data "5" from the calculation circuit 43.

When the set data is changed during an operation, the detection circuit 46 detects the changed set data and the reception circuit 47 receives the data as a changed set data signal.

Upon detection of the changed set data by the detection circuit 46, a random number generation command is output and upon receipt of this random number generation command, the calculation circuit 43 generates random numbers (for example, 0 to 9) and outputs an extracted random number (for example, 7). The storage circuit 44 updates and stores the set data of the part changed with the changed set data detected by the detection circuit 46, and updates and stores the random number data "7", to replace the stored random number data "5".

In the case where the separate type air-conditioning apparatus stops due to a power failure, the detecting means 42 detects information indicating the occurrence of a power failure and the timer 48 is activated.

Then, when power is recovered, the detecting means 42 detects information that power has been recovered and the storage circuit 44 and decision circuit 45 decide whether the own separate type air-conditioning apparatus was operating before the power failure or not. In the case where the separate type air-conditioning apparatus was not operating before the power failure, no automatic recovery is instructed. On the other hand, in the case where the separate type air-conditioning apparatus was operating before the power failure, the separate type air-conditioning apparatus is restarted according to the set data stored in the storage circuit 44 when a lapse of the delay time decided based on the random number data stored in the storage circuit 44 is detected and automatically recovers so that the own separate type air-conditioning apparatus restarts the operation under the same condition as that before the power failure.

Here, this automatic recovery operation will be explained.

At the time of recovery of power, the decision circuit 45 reads a power failure period from the timer 48 and decides whether this power failure period is shorter than the specified time which is the time necessary for the pressure balance of the compressor 11 or not.

In the case where the decision circuit 45 decides that the power failure period is shorter than the specified time, the decision circuit 45 uses the random number data stored in the storage circuit 44 and decides time T5 obtained by multiplying this random number data by, for example, 10, which is then added to specified time T0 necessary for the pressure balance of the compressor 11, that is, (T0+T5) as a delay time until a restart, and when a lapse of this delay time(T0+T5) after a recovery of power is detected, the own separate type air-conditioning apparatus is restarted and automatic recovery is performed. More specifically, in the case where the random number data is "7," a restart is performed after T0+(70 sec).

In the case where the decision circuit 45 decides that the power failure period is equal to or longer than the specified time, the decision circuit 45 uses the random number data stored in the storage circuit 44 and decides only time T5 obtained by multiplying this random number data by, for example, 10 as a delay time until a restart and when a lapse of this delay time T5 after recovery of power is detected, the own separate type air-conditioning apparatus is restarted and automatic recovery is performed. More specifically, in the case where the random number data is "7," the restart is performed after 70 seconds.

With this configuration, it is possible to decide the delay time until a restart of the separate type air-conditioning apparatus at the time of recovery of power according to the random number data.

Therefore, an operation mode of automatically recovering a plurality of air-conditioning apparatuses that are stopped by a power failure in the operation mode before the power failure after a recovery of power provides an extremely high probability that a delay time until a restart will be determined according to random number data for each air-conditioning apparatus and a plurality of air-conditioning apparatuses can be discretely restarted at the time of recovery of power and provides an extremely high probability of avoiding a case where all air-conditioning apparatuses are restarted simultaneously and stopped again due to an instantaneous voltage drop of the commercial power supply 12.

Furthermore, since the decision circuit 45 is configured so as to change the delay time until a restart according to the power failure measurement period from the timer 48, it is possible to control the pressure balance state of the compressor 11 by measurement of the power failure period and change the delay time to T0+T5 or T5 only according to the stop period, thereby to shorten the time from the recovery of power to a restart of the separate type air-conditioning apparatus and reduce a variation of the room temperature from the set temperature.

Embodiment 7

Figure 11:
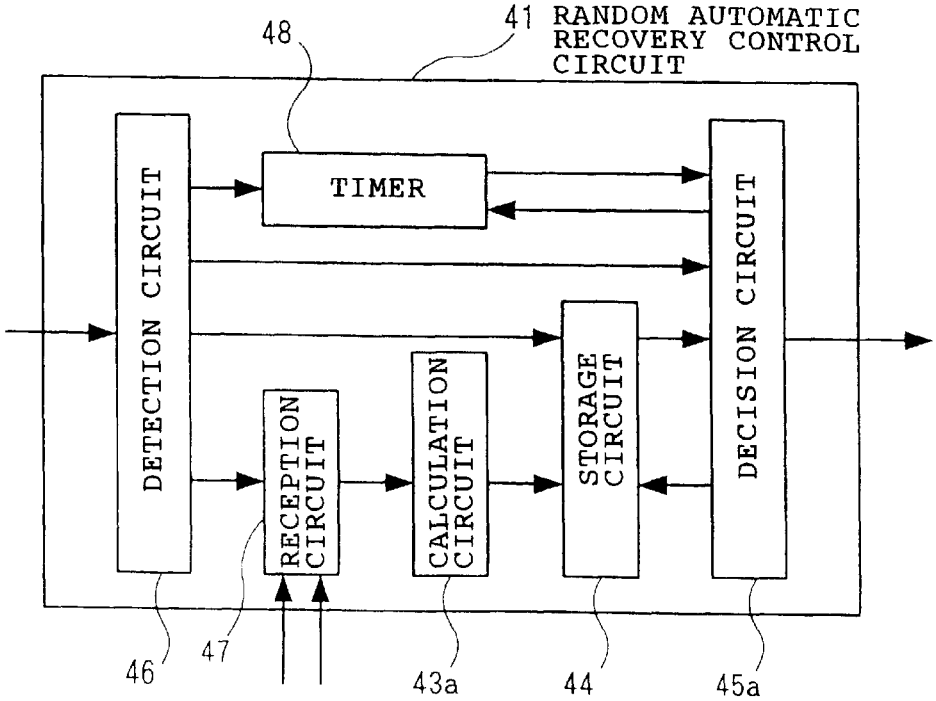
FIG. 11 is a block diagram showing a configuration of a random automatic recovery control circuit according to Embodiment 7 of the present invention.
Figure 10:
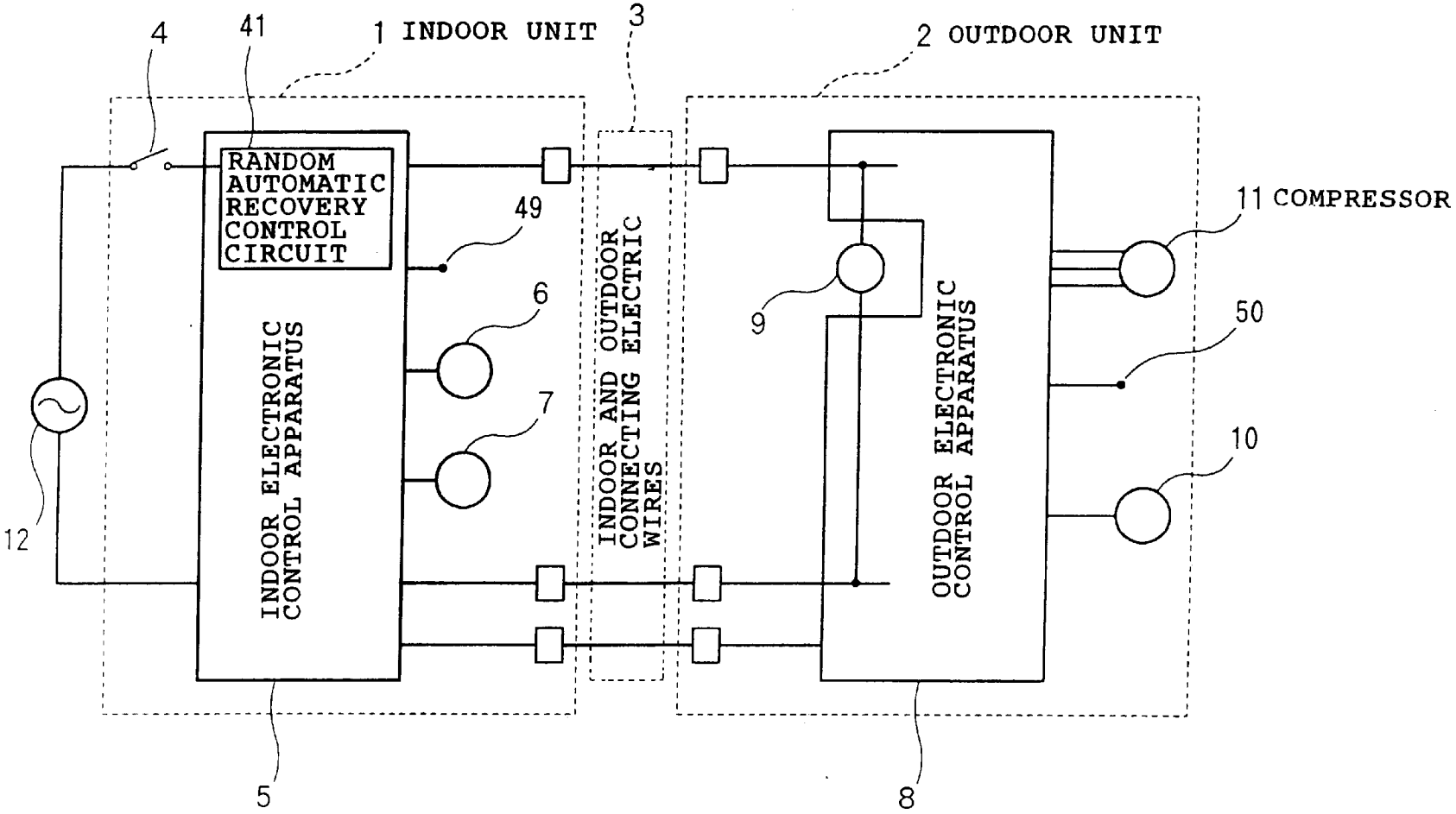
FIG. 10 is a block diagram showing a configuration of a separate type air-conditioning apparatus according to Embodiment 7 of the present invention.

As shown in FIG. 10, the air-conditioning apparatus according to Embodiment 7 is the separate type air-conditioning apparatus according to Embodiment 6 further provided with a room temperature detecting means 49 such as a suction temperature sensor that detects a room temperature and an outdoor air temperature detecting means 50 such as an outdoor air temperature sensor that detects an outdoor air temperature and is different, as shown in FIG. 11, in that a calculation circuit 43*a* is configured with a function of calculating the air-conditioning load based on the output from the room temperature detecting means 49 and the output from the outdoor air temperature detecting means 50 added to the aforementioned calculation circuit 43 of Embodiment 6 and a decision circuit 45*a* is configured with a function of correcting a delay time based on the air-conditioning load added to the aforementioned decision circuit 45 of Embodiment 6.

The room temperature detecting means 49 is connected with a reception circuit 47 of a random automatic recovery control circuit 41 via an indoor electronic control apparatus 5 of an indoor unit 1 and the outdoor air temperature detecting means 50 is connected with the reception circuit 47 of the random automatic recovery control circuit 41 via an outdoor electronic control apparatus 8 of an outdoor unit 2.

Here, the automatic recovery operation of this separate type air-conditioning apparatus will be explained below.

The reception circuit 47 receives a room temperature detection signal, which is a room temperature detected by the room temperature detecting means 49 and an outdoor air temperature detection signal, which is an outdoor air temperature detected by the outdoor air temperature detecting means 50.

The calculation circuit 43*a* calculates an air-conditioning load of the own separate type air-conditioning apparatus based on the room temperature detection signal from the room temperature detecting means 49 and the outdoor air detection signal output from the outdoor air temperature detecting means 50.

The storage circuit 44 stores the air-conditioning load calculated by the calculation circuit 43*a*. This storage circuit 44 also stores a data table that lists the correction time corresponding to the magnitude of the air-conditioning load in a table form.

At the time of recovery of power, the decision circuit 45*a* finds the correction time corresponding to the air-conditioning load read from the storage circuit 44 by searching from the data table, corrects specified time T0, which is the time necessary for the pressure balance of the compressor 11 with the correction time, and calculates specified time T6 after the correction.

Then, the decision circuit 45*a* reads a power failure period from the timer 48 and decides whether or not this stop period is shorter than the specified time (T6) after the correction.

In the case where the decision circuit 45*a* decides that the power failure period is shorter than the specified time (T6) after the correction, the decision circuit 45*a* decides specified time T6 after the correction plus time T5 corresponding to the random number data, that is (T6+T5), as a delay time until a restart and when a lapse of this delay time (T6+T5) after the recovery of power is detected, the own separate type air-conditioning apparatus is restarted and automatic recovery is performed.

In the case where the decision circuit 45*a* decides that the power failure period is equal to or longer than the specified time (T6) after the correction, the decision circuit 45*a* decides only time T5 as a delay time until a restart and when a lapse of delay time T5 after the recovery of power is detected, the own separate type air-conditioning apparatus is restarted and automatic recovery is performed.

Measuring a room temperature and an outdoor air temperature makes it possible to define the air-conditioning load of the separate type air-conditioning apparatus, correct and optimize a delay time after a recovery of power until a restart of the separate type air-conditioning apparatus based on the air-conditioning load, and reduce a variation of the room temperature from the set temperature.

Embodiment 8

Figure 12:
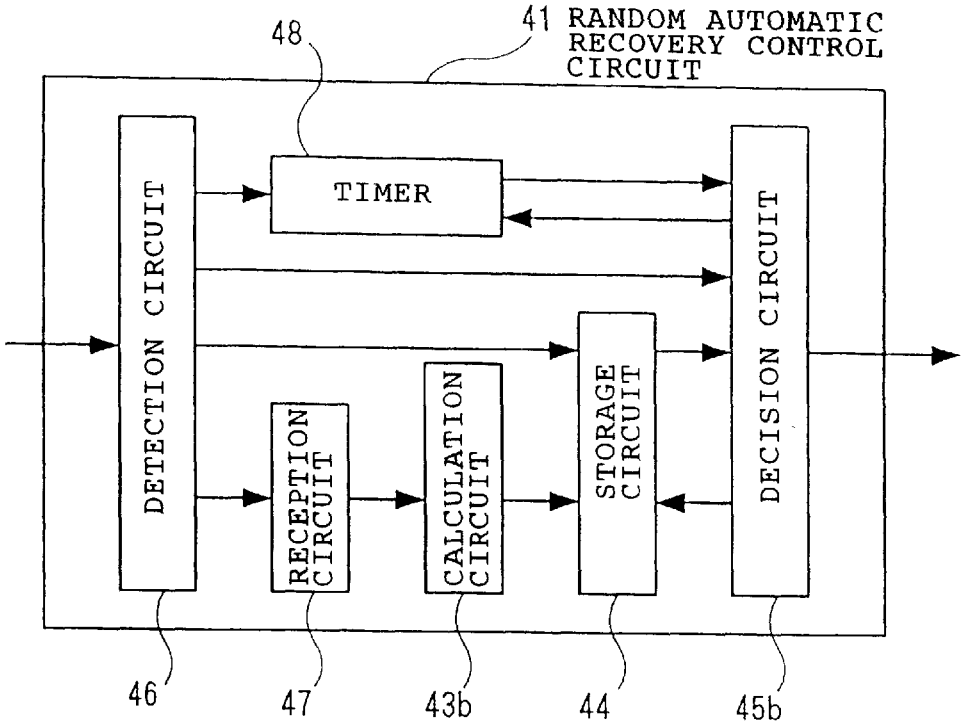
FIG. 12 is a block diagram showing a configuration of a random automatic recovery control circuit according to Embodiment 8 of the present invention.

As shown in FIG. 12, the air-conditioning apparatus according to Embodiment 8 of the present invention is different in that a calculation circuit 43*b* is configured with a function of calculating the main unit load based on the set data stored in the storage circuit 44 added to the calculation circuit 43 of Embodiment 6 above and a decision circuit 45*b* is configured with a function of correcting a delay time based on the main unit load added to the decision circuit 45 of Embodiment 6 above.

Here, the automatic recovery operation of the separate type air-conditioning apparatus will be explained below.

The calculation circuit 43*b* calculates the main unit load of the separate type air-conditioning apparatus based on set data such as operation mode, volume of air and wind direction data stored in the storage circuit 44. The main unit load of this separate type air-conditioning apparatus includes not only the air-conditioning load but also operation load such as the indoor fan motor 6, louver motor 7 and outdoor fan motor 10, which are the components of the separate type air-conditioning apparatus.

The storage circuit 44 stores the main unit load calculated by the calculation circuit 43*b*. This storage circuit 44 also stores a data table that lists the correction time corresponding to the magnitude of the main unit load in a table form.

At the time of recovery of power, the decision circuit 45*b* finds the correction time corresponding to the main unit load read from the storage circuit 44 by searching from the data table, corrects specified time T0 which is the time necessary for the pressure balance of the compressor 11 with the correction time and calculates specified time T7 after the correction.

Then, the decision circuit 45*b* reads a power failure period from the timer 48 and decides whether or not this stop period is shorter than the specified time (T7) after the correction.

In the case where the decision circuit 45b decides that the power failure period is shorter than the specified time (T7) after the correction, the decision circuit 45*b* decides specified time T7 after the correction plus time T5 corresponding to the random number data, that is (T7+T5), as a delay time until a restart, and when a lapse of this delay time (T7+T5) after the recovery of power is detected, the own separate type air-conditioning apparatus is restarted and automatic recovery is performed.

In the case where the decision circuit 45*b* decides that the power failure period is equal to or longer than the specified time (T7) after the correction, the decision circuit 45*b* decides only time T5 as a delay time until a restart, and when a lapse of delay time T5 after the recovery of power is detected, the own separate type air-conditioning apparatus is restarted and automatic recovery is performed.

Using set data such as operation mode, volume of air and wind direction makes it possible to define the air-conditioning load of the separate type air-conditioning apparatus, correct and optimize a delay time after recovery of power until a restart of the separate type air-conditioning apparatus based on the main unit load, reduce the starting current of the separate type air-conditioning apparatus by optimizing the pressure balance state of the compressor 11 and reduce a voltage drop of the commercial power supply 12.

Embodiment 9

Figure 13:
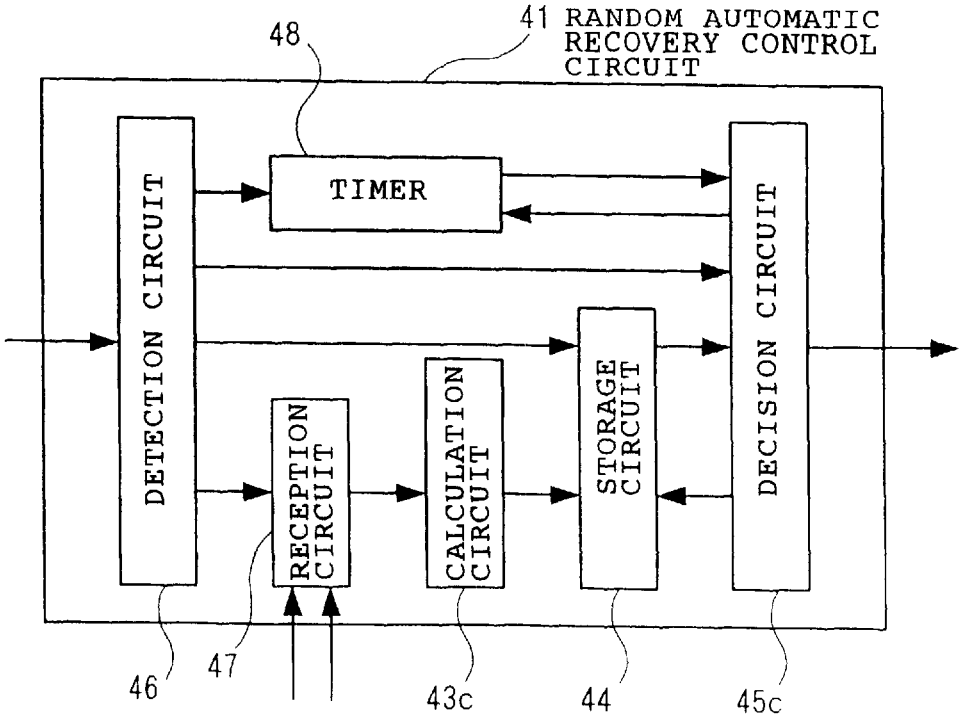
FIG. 13 is a block diagram showing a configuration of a random automatic recovery control circuit according to Embodiment 9 of the present invention.

The air-conditioning apparatus according to Embodiment 9 of the present invention is also provided with the room temperature detecting means 49 shown in Embodiment 7 but is different, as shown in FIG. 13, in that a calculation circuit 43*c* is configured with a function of calculating the main unit load based on the room temperature detected by the room temperature detecting means 49 and the set temperature stored in the storage circuit 44 added to the aforementioned calculation circuit 43 of Embodiment 6 and a decision circuit 45*c* is configured with a function of correcting a delay time based on the above main unit load added to the aforementioned decision circuit 45 of Embodiment 6.

Here, the automatic recovery operation of this separate type air-conditioning apparatus will be explained below.

The calculation circuit 43*c* calculates the main unit load by calculating the operation state (thermostat OFF, operation frequency variation, etc.) of the separate type air-conditioning apparatus based on the room temperature detection signal detected by the room temperature detecting means 49 and the set room temperature data stored in the storage circuit 44.

The storage circuit 44 stores the main unit load calculated by the calculation circuit 43*c*. This storage circuit 44 also stores a data table that lists the correction time corresponding to the magnitude of the main unit load in a table form.

At the time of recovery of power, the decision circuit 45*c* finds the correction time corresponding to the main unit load read from the storage circuit 44 by searching from the data table, corrects specified time T0, which is the time necessary for the pressure balance of the compressor 11, with the above described correction time and calculates specified time T8 after the correction.

Then, the decision circuit 45*c* reads the power failure period from the timer 48 and judges whether this power failure period is shorter than a specified time (T8) after the correction.

In the case where the decision circuit 45*c* decides that the power failure period is shorter than the specified time (T8), the decision circuit 45*c* decides the time T5 corresponding to the random number data added to the specified time T8 after the correction, that is, (T8+T5) as a delay time until a restart, and when a lapse of this delay time (T8+T5) after recovery of power is detected, the own separate type air-conditioning apparatus is restarted and automatic recovery is performed.

In the case where the decision circuit 45*c* decides that the power failure period is equal to or longer than the specified time (T8), the decision circuit 45*c* decides only time T5 as a delay time until a restart and when a lapse of this delay time T5 after recovery of power is detected, the own separate type air-conditioning apparatus is restarted and automatic recovery is performed.

Controlling the room temperature and set temperature makes it possible to consider the operation state with the thermostat tuned OFF or with varied operation frequencies of the separate type air-conditioning apparatus, define the main unit load more clearly, correct and optimally minimize the delay time from the recovery of power to a restart of the separate type air-conditioning apparatus based on the main unit load, reduce the starting current of the separate type air-conditioning apparatus by optimizing the pressure balance state of the compressor 11, reduce a voltage drop of the commercial power supply, and reduce a variation of the room temperature from the set temperature.

Embodiment 10

Figure 14:
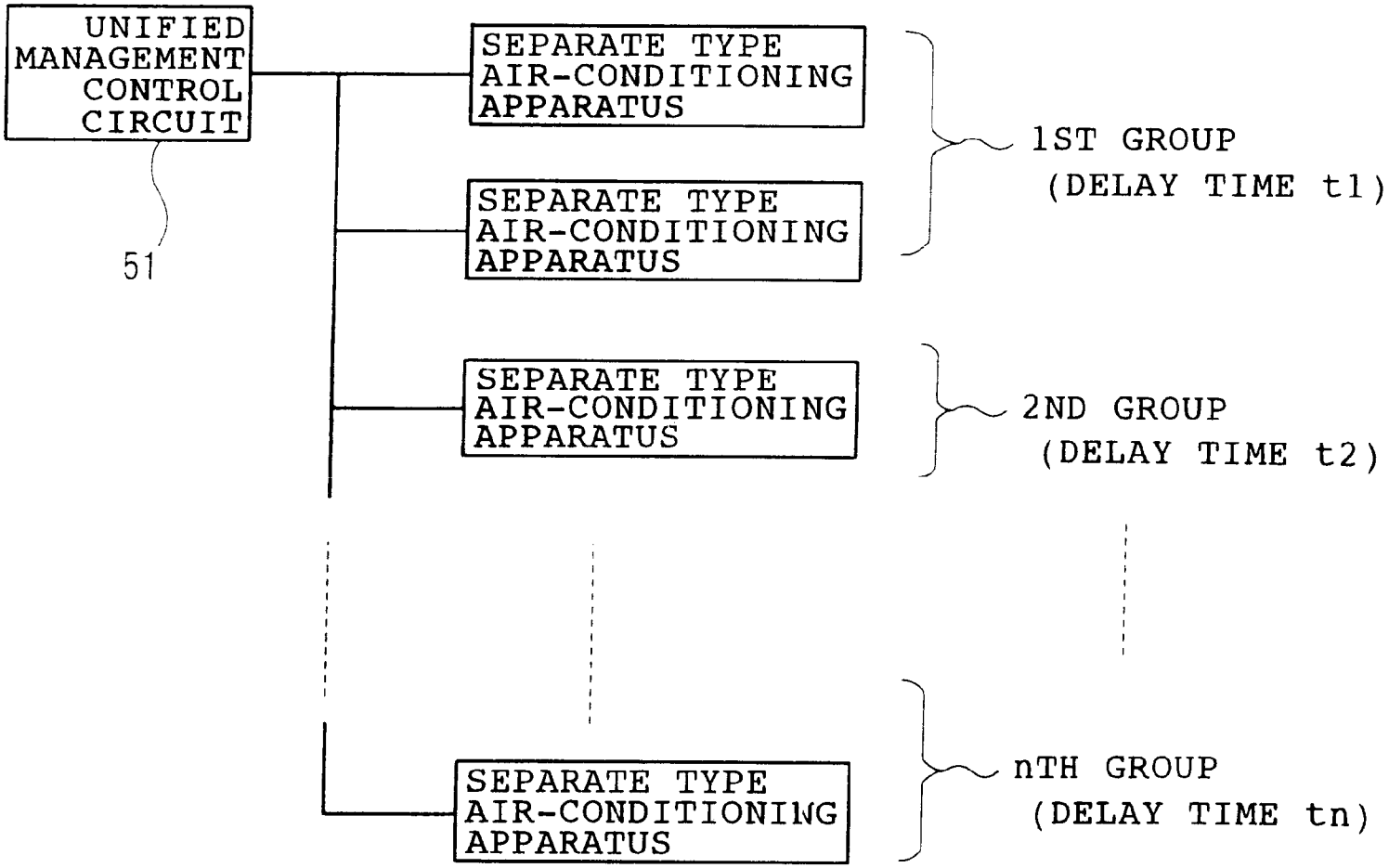
FIG. 14 is a block diagram showing a use example of a unified management control circuit according to Embodiment 10 of the present invention.

As shown in FIG. 14, the air-conditioning apparatus of Embodiment 10 of the present invention is different in that a unified management control apparatus 51 is provided that instructs a plurality of separate type air-conditioning apparatuses to have delay times t1 to tn varying among a number of groups. The lengths of delay times t1 to tn are decided based on random numbers, and the delay times t1 to tn are expected to be automatically set at different times.

The unified management control apparatus 51 separates a plurality of separate type air-conditioning apparatuses into a number of groups and indicates a delay time decided based on random numbers for each group.

This embodiment is the is the same as Embodiment 5 except that a delay time is decided by the unified management control apparatus 51 based on random numbers, and therefore a specific example will be omitted.

What is claimed is:

1. An operation control method for controlling air-conditioning apparatus, wherein when a plurality of air-conditioning apparatuses operating in an operational mode and stopped by a power failure are automatically recovered to resume said operational mode after a recovery of power, comprising the steps of:

generating and deciding a delay time of a restart of a plurality of air-conditioning apparatuses on the basis of data obtained by converting into variable numbers random number data generated in a calculation circuit or immediately antecedent operation setting data, and discretely restarting, at the time of recovery of power on the basis of the delay time, the plurality of air-conditioning apparatuses with different delay times or delay times varying among a number of groups of the air-conditioning apparatuses.

2. An operation control method for controlling air-conditioning apparatus, wherein when a plurality of air-conditioning apparatuses operating in an operational mode and stopped by a power failure are automatically recovered to resume said operational mode after a recovery of power, comprising the steps of:

deciding delay times at the time of recovery of power for restarting air-conditioning apparatuses according to respective air-conditioning apparatus load or operation state before the power failure, and restarting said respective air-conditioning apparatuses according to said respective decided delay times.

3. The operation control method for controlling air-conditioning apparatus according to claim 2, further comprising the steps of:

deciding respective second delay times by adding randomly generated times to the respective decided delay times; and restarting said respective air-conditioning apparatuses according to said respective second delay times.

4. The operation control method for controlling air-conditioning apparatus according to claim 2, wherein the delay times are changed according to the duration of the power failure.

5. An air-conditioning apparatus comprising:

a timer for measuring a power failure period;

a detecting means for detecting set data that determines operation of air-conditioning apparatus;

a calculation circuit for converting the detected set data to variable data;

a storage circuit for storing the detected set data and the variable data; and a decision circuit for deciding a delay time until a restart of the air-conditioning apparatus according to said variable data and according to the measured power failure period.

6. An air-conditioning apparatus comprising:

a detecting means for detecting set data that determines the operation of air-conditioning apparatus;

a calculation circuit for converting the detected set data to variable data and for calculating air-conditioning load based on output from a room temperature detecting means for detecting a room temperature and output from an outdoor air temperature detecting means for detecting an outdoor air temperature;

a storage circuit for storing the detected set data and the variable data; and a decision circuit for deciding a delay time until restart of the air-conditioning apparatus according to said variable data, said decision circuit for correcting said delay time based on said air-conditioning load.

7. An air-conditioning apparatus comprising:

a detecting means for detecting set data that determines operation of air-conditioning apparatus;

a storage circuit for storing the detected set data and the variable data;

a calculation circuit for converting the detected set data to variable data and for calculating a main unit load based on the stored set data; and a decision circuit for deciding a delay time until a restart of the air-conditioning apparatus according to said variable data and correcting said delay time based on said main unit load.

8. The air-conditioning apparatus according to claim 7, wherein the calculation circuit for converting the detected set data to variable data and calculating main unit load based on a room temperature detected by a room temperature detecting means.

9. An air-conditioning apparatus comprising:

a timer for measuring a power failure period;

a detecting means for detecting set data that determines operation of air-conditioning apparatus;

a calculation circuit for generating random number data under instructions from said detecting means;

a storage circuit for storing the detected set data and the random number data; and a decision circuit for deciding a delay time until a restart of the air-conditioning apparatus according to the measured power failure period from said timer and changing said decided delay time according to said random number data.

10. An air-conditioning apparatus comprising:

a detecting means for detecting set data that determines operation of air-conditioning apparatus;

a calculation circuit for generating random number data under instructions from said detecting means and calculating the air-conditioning load based on the output from a room temperature detecting means for detecting a room temperature and the output from an outdoor air temperature detecting means for detecting an outdoor air temperature, a storage circuit for storing the detected set data and the random number data; and a decision circuit for deciding a delay time until a restart of the air-conditioning apparatus according to said random number data and for correcting said decided delay time based on said air-conditioning load.

11. The air-conditioning apparatus according to claim 10, wherein said calculation circuit is for generating random number data under instructions from said detecting means and calculating a main unit load based on the stored set data.

12. The air-conditioning apparatus according to claim 10, wherein the calculation circuit is for generating random number data under instructions from said detecting means and calculating a main unit load based on a room temperature detected by a room temperature detecting means and a set temperature stored in the storage circuit.

* * * * *